US007503729B2

(12) United States Patent
Hammer et al.

(10) Patent No.: US 7,503,729 B2
(45) Date of Patent: Mar. 17, 2009

(54) REINFORCED RETAINING WALL AND METHOD OF CONSTRUCTION

(75) Inventors: James Hammer, University Place, WA (US); Michael Simac, Cramerton, NC (US)

(73) Assignee: Westblock Systems, Inc., Salem, OR (US)

( * ) Notice: Subject to any disclaimer, the term of this patent is extended or adjusted under 35 U.S.C. 154(b) by 237 days.

(21) Appl. No.: 10/591,736

(22) PCT Filed: Mar. 15, 2005

(86) PCT No.: PCT/US2005/008744

§ 371 (c)(1), (2), (4) Date: Sep. 1, 2006

(87) PCT Pub. No.: WO2005/100700

PCT Pub. Date: Oct. 27, 2005

(65) Prior Publication Data

US 2007/0196184 A1 Aug. 23, 2007

Related U.S. Application Data

(60) Provisional application No. 60/562,720, filed on Apr. 15, 2004, provisional application No. 60/559,328, filed on Apr. 1, 2004.

(51) Int. Cl.
*E02D 29/02* (2006.01)

(52) U.S. Cl. ..... 405/286; 405/284

(58) Field of Classification Search ..... 405/262, 405/284, 285, 286

See application file for complete search history.

(56) References Cited

U.S. PATENT DOCUMENTS

| | | | | |
|---|---|---|---|---|
| 2,881,614 | A | 4/1959 | Preininger | |
| 4,000,622 | A * | 1/1977 | Chiaves | 405/286 |
| 4,107,895 | A | 8/1978 | LeGrady | |
| 4,193,718 | A | 3/1980 | Wahrendorf et al. | |
| 4,337,605 | A | 7/1982 | Tudek | |
| 4,659,261 | A * | 4/1987 | Chiaves | 405/286 |
| 4,726,567 | A | 2/1988 | Greenberg | |
| 4,896,999 | A | 1/1990 | Ruckstuhl | |
| 5,350,256 | A | 9/1994 | Hammer | |
| 5,707,184 | A | 1/1998 | Anderson et al. | |
| 6,050,749 | A | 4/2000 | Khamis | |
| 6,089,792 | A * | 7/2000 | Khamis | 405/262 |
| 6,416,260 | B1 * | 7/2002 | Khamis | 405/286 |
| 6,565,289 | B2 * | 5/2003 | Khamis | 405/286 |

OTHER PUBLICATIONS

International Search Report and Written Opinion of PCT Appl. No. PCT/US2005/008744.

* cited by examiner

*Primary Examiner*—Frederick L Lagman
(74) *Attorney, Agent, or Firm*—Klarquist Sparkman, LLP

(57) ABSTRACT

The present disclosure concerns methods for constructing a dry-stacked retaining wall that is reinforced to increase the sliding resistance of the wall. In particular embodiments, a concrete footing or base is formed in trench below the lowermost course of retaining wall blocks and extends upwardly into voids in the lowermost course of the wall. The voids can be, for example, chambers or openings defined between adjacent blocks or vertically extending cores formed in the blocks.

38 Claims, 5 Drawing Sheets

REINFORCED RETAINING WALL AND METHOD OF CONSTRUCTION

CROSS REFERENCE TO RELATED APPLICATIONS

This is the U.S. national stage application of PCT Application No. PCT/US2005/008744, filed Mar. 15, 2005, which claims the benefit of U.S. Provisional Application No. 60/559,328, filed Apr. 1, 2004 and U.S. Provisional Patent Application No. 60/562,720, filed Apr. 15, 2004, both of which are incorporated herein by reference.

FIELD

The present disclosure concerns embodiments of a reinforced retaining wall of retaining wall blocks that better resists outward forces exerted by retained earth, and methods for constructing a reinforced retaining wall.

BACKGROUND

Conventional retaining walls are used to secure earth embankments against sliding and slumping. Retaining walls are made of various materials such as concrete, solid masonry, wood ties, bricks and blocks of stone and concrete. Typically, blocks are placed in rows, or courses, overlaying on top of each other to form a wall. In retaining walls constructed from dry-stacked retaining blocks (i.e., walls constructed without mortar between courses), pins or rods typically are used to interconnect blocks of a lower course with vertically adjacent blocks in an overlying course. For taller walls, a horizontal tie-back sheet (commonly referred to as a geofabric or geogrid) may be located between adjacent layers of blocks, and extended rearwardly into an excavated area to be backfilled for retaining the wall against the outward force of the earth being retained. Retaining wall blocks used for relatively short walls, such as used in gardens or in landscaping applications, may be formed with integral vertical flanges or projections that engage corresponding grooves or surfaces of blocks in a vertically adjacent course to help stabilize the wall.

Another type of retaining wall system uses block assemblies having two or more interlocking subcomponents. Such a system is shown in U.S. Pat. No. 5,688,078 to Hammer. In this system, each block assembly includes a frontal or face block that is exposed in the front surface of the wall, a trunk block extending perpendicularly from the rear of the face block, and an anchor block connected to the rear end of the trunk block. The block assemblies are shaped to form spaces or voids between laterally adjacent block assemblies, which are filled with a backfill material. Additional trunk and anchor blocks can be included in each block assembly to extend the assembly deeper into the slope for adding anchoring strength. This type of wall system is advantageous in that it generally does not require the use of tie-back sheets, which require substantial earthmoving and careful filling and grading of one course at a time.

When constructing a wall, the base width of the wall (the width of the lowermost course) must extend a sufficient distance into the embankment relative to the overall wall height to resist outward movement of the embankment. The allowable height-to-width ratio of a wall depends in part on the type of retaining wall system used and the type of soil in the embankment and upon which the wall is constructed. Thus, for a specified wall height, the base width of the wall typically must be increased as the stability of the soil decreases to maintain a minimum sliding resistance. Unfortunately, increasing the base width of a wall requires additional materials and possibly additional excavation, which can be cost prohibitive. Additionally, in some cases, the embankment may not be wide enough to accommodate the placement of courses of the required width.

SUMMARY

Accordingly, the present disclosure concerns methods for constructing a dry-stacked retaining wall that is reinforced to increase the sliding resistance of the wall. In one embodiment, a concrete footing or base is formed in a trench below the lowermost course of retaining wall blocks and extends upwardly into voids in the lowermost course of the wall. The voids can be chambers or openings defined between adjacent blocks or vertically extending cores formed in the blocks. The footing interconnects the lowermost course of blocks with the ground, thereby increasing the sliding resistance of the wall. This allows the wall to be constructed with a smaller base width than would normally be required, which minimizes excavation and provides more space in the embankment behind the wall, such as for the placement of utility easements or other structures. The retaining wall system can also reduce both material and labor costs compared with other types of wall systems.

The foregoing and other features and advantages of the invention will become more apparent from the following description of several embodiments, which proceeds with reference to the accompanying figures.

DETAILED DESCRIPTION

As used herein, the singular forms "a," "an," and "the" refer to one or more than one, unless the context clearly dictates otherwise.

As used herein, the term "includes" means "comprises."

Figure 1:
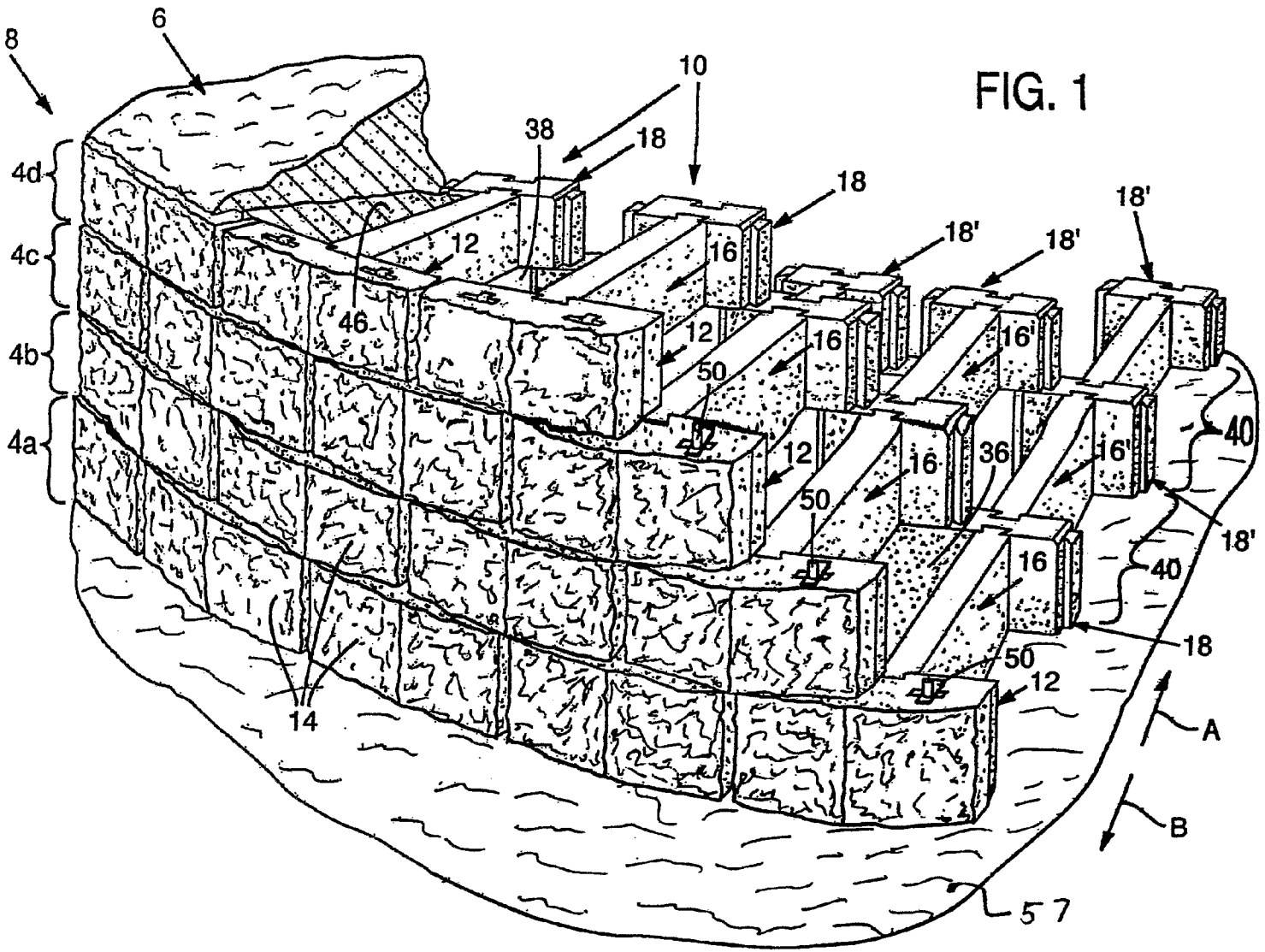
FIG. 1 is a perspective view of a portion of a reinforced retaining wall constructed from a plurality of dry-stacked retaining wall block assemblies, according to one embodiment.

FIG. 1 shows a retaining wall 8 for retaining an embankment 6. The wall 8 is constructed from several vertically stacked courses or layers, such as layers 4*a*, 4*b*, 4*c*, and 4*d*. Each course is generally horizontal and extends in a rearward direction A into the embankment 6.

Each course of the illustrated wall 8 is formed of side-by-side generally I-shaped block assemblies 10. A concrete base or footing 36 is formed in a trench 56 (FIG. 7) in the earth or ground below the lowermost course 4*a* and extends upwardly into the lowermost course 4*a* between the block assemblies 10. The footing 36 interconnects the lowermost course 14*a* with ground to better resist against sliding forces exerted against the wall by the embankment in the forward or outward direction B.

Figure 2:
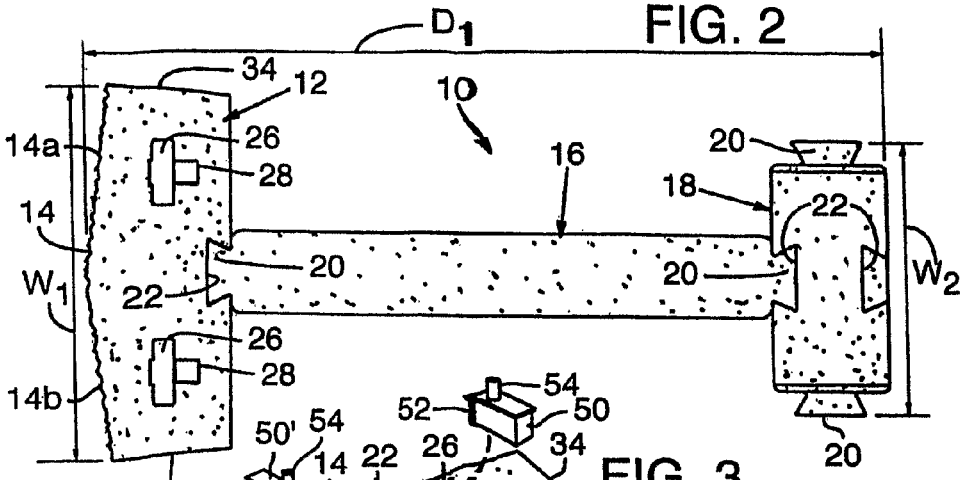
FIG. 2 is a top plan view of one of the block assemblies of the retaining wall of FIG. 1.
Figure 14:
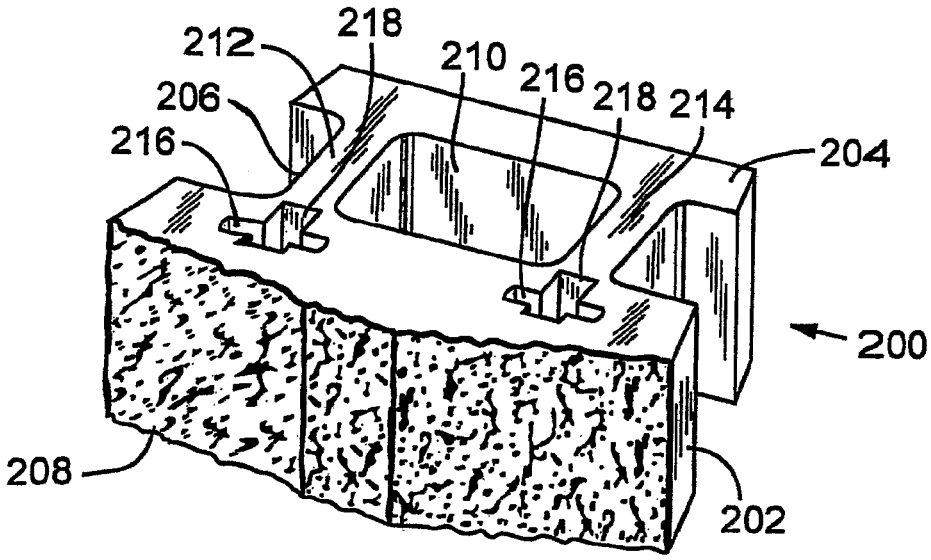
FIG. 14 is a perspective view of an exemplary unitary retaining wall block that can be used for constructing reinforced retaining walls, according to the methods disclosed herein.
Figure 15:
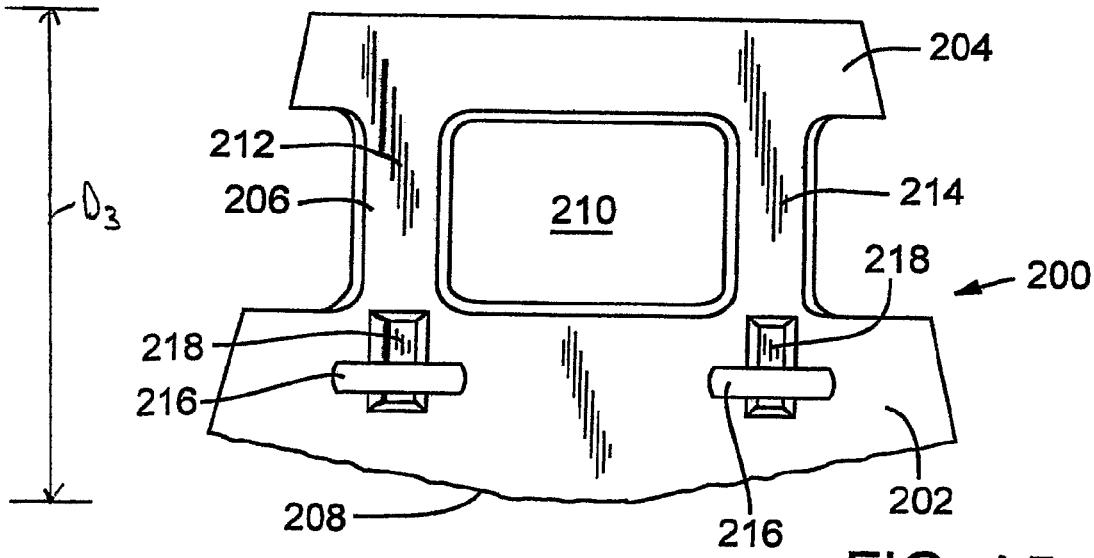
FIG. 15 is a top plan view of the retaining wall block of FIG. 14.

Referring to FIG. 2, each block assembly 10 in the illustrated configuration typically includes at least three interlocked, vertically oriented subcomponents, including a front or face block 12, an intermediate or trunk block 16, and a rear or anchor block 18. Additional blocks can be added to an assembly to increase the depth of the assembly, as further described below. In other embodiments, the wall courses can be constructed from a plurality of side-by-side unitary blocks (e.g., block 200 shown in FIGS. 14 and 15), instead of side-by-side block assemblies.

As shown, the face block 12 has a face or front surface 14 that is exposed in the front surface of a wall. The front surface 14 desirably has textured or broken face resembling natural stone. The trunk block 16 is attached to the rear of the face block 12 at a vertical medial junction thereon. The trunk block 16 extends perpendicularly from the face block 12 in the rearward direction. The anchor block 18 is attached to the rearward end of the trunk block 16 so that it is parallel to the face block 12, with the trunk block being attached to the anchor block at a vertical medial junction.

The front face 14 of the face block 12 can have any of various configurations. In the illustrated embodiment, for example, the front face 14 has a two-faceted front face configuration having first and second angled and roughened surfaces 14*a* and 14*b*. In other embodiments, the front face can have a convex curved surface, a single-faceted configuration, or a three-faceted configuration comprising a center facet and two angled side surfaces extending rearwardly from respective sides of the center facet. The face may also have various surface textures.

When constructing a wall, the face block 12, trunk block 16, and anchor block 18 are assembled to provide an interconnected I-shaped assembly 10, as depicted in FIG. 1. In the interconnected state, the components of the assembly 10 may not be disconnected or separated in any lateral direction (i.e., side-to-side or front-to-back in a wall) without breakage. The block components in the illustrated embodiment are not merely held in place by frictional forces and the presence of adjacent unconnected blocks. Each block component is securely mechanically engaged to at least one other adjacent block component of the same block assembly 10.

In particular embodiments, the face block 12, trunk block 16, and anchor block 18 are interconnected by dovetail joints so that they may be separated only by vertically sliding one block component with respect to an attached block component. A dovetail joint may be formed in any of a wide variety of geometries as long as the block components are connected against lateral separation. Dovetail joints generally have a male key or tongue 20 that mates with a female slot or groove 22. Typically, the tongue is wider at some position toward its free end than at another position closer to its root. The female groove 22 is configured to closely conform to the male shape of a tongue 20. In the illustrated embodiment, the face block 12 and anchor block 18 define the vertical grooves 22, which are generally trapezoidal, with the face being wider than the aperture at the surface of each block. Compatible male tongues 20 are integrally formed on the ends of the trunk block 16, with the free end being wider than the root.

Although less desirable, the face block and the trunk block can be formed as a single unit that is interconnected with a separable anchor block. Thus, in this configuration, the block assembly has only two interconnected block components. In a similar manner, the trunk block and the anchor block can be formed as a single unit that is interconnected with a separable face block.

Figure 3:
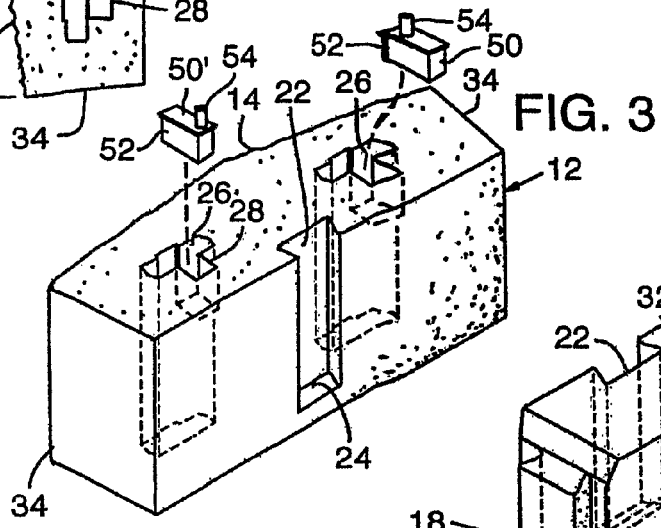
FIG. 3 is a perspective view of a front block of the block assembly shown in FIG. 2, including block-connecting elements.

FIG. 3 shows the face block 12 with the groove 22 only partially bisecting the block. The groove 22 does not entirely pass through the block, but terminates at a sloped end surface 24 that faces generally upward and rearwardly of the block. Thus, the lower portion of the face block 12 is solid and unbroken by the groove 22, thereby increasing the strength of the block and decreasing the risk of breakage at the groove 22.

Figure 4:
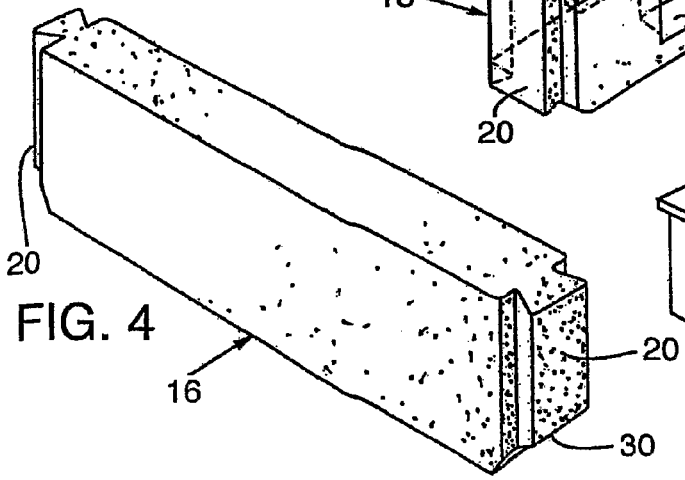
FIG. 4 is a perspective view of a trunk block of the block assembly shown in FIG. 2.

FIG. 4 shows the trunk block 16 with a male tongue 20 at each end of the block. Each tongue 20 desirably has a sloped lower end 30 corresponding to the end surface 24 of a corresponding female groove 22 in the face block 12 or the anchor block 18. Desirably, the tongue 20 does not extend the length of the block, but stops at the sloped end 30 to permit the trunk block 16 and the face block 12 to be interconnected with provide flush top and bottom surfaces. In other embodiments, the tongues 20 and grooves 22 can extend the entire height of the respective block component.

Figure 5:
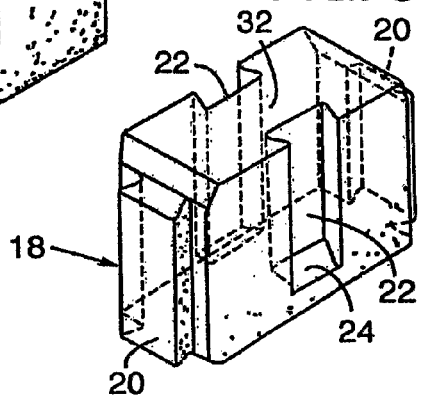
FIG. 5 is a perspective view of an anchor block of the block assembly shown in FIG. 2.

FIG. 5 is a perspective view of the anchor block 18. The illustrated anchor block 18 desirably is formed with a female groove 22 centrally defined on the front and rear faces according to the configuration of the groove 22 formed in the face block 12. The grooves 22 are oriented back-to-back and spaced apart by a solid web 32 of block material to provide adequate strength. The anchor block 18 also may be formed with a male tongue 20 on each end, as depicted in FIG. 5. This allows the anchor block 18 to be optionally used as a trunk block to provide a block assembly having an overall depth that is shorter than the depth of the block assembly 10 shown in FIG. 1.

The tongues 20 and grooves 22 are all similarly tapered along their vertical lengths so that each dovetail joint is secured against excess motion and slippage by the respective tongue 20 being wedged into the respective groove 22. In a maximum material condition (i.e., when the spaces between adjacent block assemblies are completely filled with a fill material (e.g., gravel)), the trunk block 16 may ride slightly above a flush alignment with the adjoining blocks. In a minimum material condition (i.e., when the spaces between adjacent block assemblies are less than completely filled), the end surface 24 of a groove 22 and the sloped end 30 of a corresponding tongue 20 will abut to prevent the trunk block from being excessively below an aligned level.

As shown in FIGS. 2 and 3, the face block 12 desirably includes alignment channels 26 defining oblong bores elongated in the direction of the width of the block and passing vertically through the entire block. In addition, the face block 12 may be formed with pockets or recesses 28 elongated in the direction of the depth of the block and intersecting respective alignment channels 26. As shown in FIG. 3, the rear portions of the pockets 28 desirably extend to a limited depth toward the bottom of the block.

Figure 6:
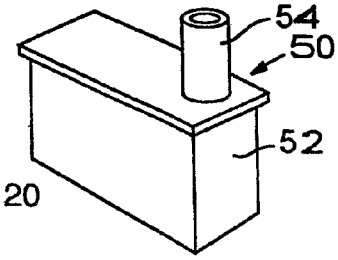
FIG. 6 is an enlarged, perspective view of one of the block-connecting elements shown in FIG. 2, according to one embodiment, used for interconnecting vertically adjacent blocks.

The pockets 28 are configured to receive block-connecting elements 50 to interconnect the face block 12 with two offset face blocks of an overlying course. As best shown in FIG. 6, each block-connecting element 50 in the illustrated embodiment includes a lower portion comprising a rectangular plug 52 and an upper portion comprising a pin or rod 54. Pockets 28 serve as receptacles for receiving plugs 52 with their projecting pins. The bottom of channels 26 serve as receptacles for receiving respective pins 54 that extend upwardly from blocks in an underlying course.

In use, the plug 52 of a block-connecting element 50 is inserted into a pocket 28 and the pin 54 is inserted into an alignment channel 26 of an overlaying face block. As shown, the pin 54 is offset toward one end of the plug 52 to accommodate vertical walls and setback walls. If a vertical wall is desired, the block-connecting elements 50 are inserted into respective pockets 28 in a "forward" direction (as depicted by block-connecting element 50 in FIG. 2) so that the pins 54 are closer to the front surface of the face block 12. If a setback wall is desired, the block-connecting elements are inserted into respective pockets 28 in a "reversed" direction (as depicted by block-connecting element 50' in FIG. 2) so that the pins are closer to the rear surface of the face block 12.

Since the alignment channels 26 are elongated in the direction of the block width, the channels provide lateral accommodation for block offset in curved walls with setback. Desirably, the alignment channels 26 are generally centered on the "quarter points" of the upper surface of the face block 12; that is, each channel 26 is centered at a location that is spaced from an adjacent side 34 of the block a distance equal to one-quarter the total block width (i.e., the distance between sides 34). This facilitates wall construction when building curved walls.

In alternative embodiments, the alignment channels 26 may be used to retain vertical reinforcing bars passing vertically through several layers, or courses, of a wall, in lieu of block-connecting elements 50.

In the retaining wall 8 shown in FIG. 1, the block assemblies 10 are placed side-by-side with respect to each other in each course so that their trunk blocks 16 are generally parallel and the face blocks 12 are positioned side-by-side in a continuous line. Thus, a pair of adjacent assemblies defines a generally rectangular void or chamber 38 suitable for filling with a suitable backfill material 46 (desirably aggregate) to provide stability and drainage. Each chamber 38 is defined at its sides by the trunk blocks 16 of the respective assemblies 10 and at its front and rear by the face blocks 12 and anchor blocks 16 of the respective assemblies.

Each course may be set back by a small distance with respect to an adjacent lower course to create a slightly sloping wall face, although in other implementations the successive courses can be vertically aligned to form a vertical wall without a setback. Nonetheless, each face block 12 rests on two face blocks 12 of a lower layer and each anchor block 18 rests on two anchor blocks of a lower layer, with each trunk block 16 being suspended above a chamber 38 in the layer below.

For additional stability, block-connecting elements 50 can be used to interconnect vertically adjacent face blocks 12, in the manner described above. Since each face block 12 is supported by two face blocks 12 of a lower layer, one alignment channel 26 of a face block receives a pin 54 of a block-connecting element 50 that is supported in a pocket 28 of one of the supporting face blocks in the layer below and the other alignment channel 26 receives a pin 54 of a block-connecting element 50 that is supported in a pocket 28 of the other supporting face block in the layer below.

As best shown in FIG. 2, the face block 12 has a width $W_1$ defined between the side surfaces 34 and the anchor block 18 has a width $W_2$ defined between the tongues 20 formed on its opposite ends. The width $W_1$ desirably is greater than the width $W_2$ so that convex curved walls may be formed by bringing together adjacent anchor blocks 18 in a course closer than a parallel spacing would ordinarily dictate. To form a concave wall, the anchor blocks 18 are spaced apart wider than ordinarily dictated but are not spaced apart so far that each anchor block 18 does not rest on the ends of the spaced apart anchor blocks of a lower layer. If a more sharply concave wall is desired, separate anchor blocks may be positioned between adjacent anchor blocks of the block assemblies 10 to support any unsupported anchor blocks in an overlaying course.

As shown in FIG. 2, each block assembly 10 has a depth $D_1$ defined by the distance between the front surface 14 of the front block 12 and the rear surface of the anchor block 18. For additional anchoring stability in a wall, particularly in the lower layers of walls having several layers, the depths of the assemblies 10 may be extended in the rearward direction by attaching one or more extension assemblies 40 (FIG. 1). As shown in FIG. 1, each extension assembly 40 includes an anchor block 18' attached perpendicularly to a trunk block 16' in a T-shaped arrangement as in a standard assembly 10. In each extension assembly 40, the trunk block 16' attaches to and extends perpendicularly from the center of the anchor block 18 of the standard assembly 10.

Figure 7:
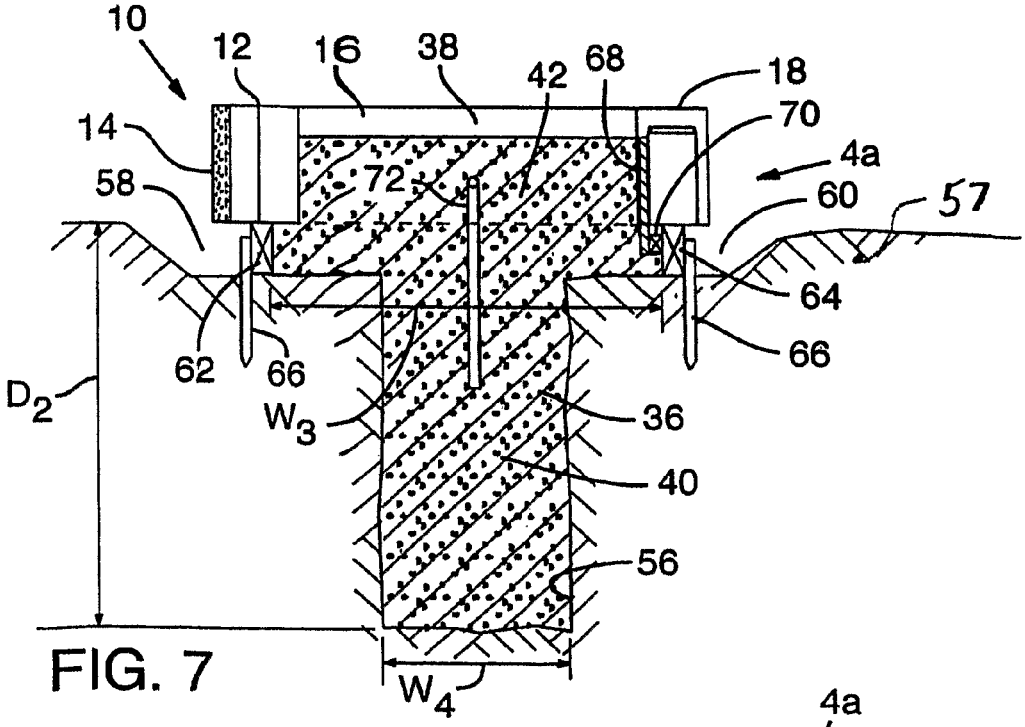
FIG. 7 is a vertical cross-sectional view of a retaining wall under construction showing a method for forming a concrete footing at the base and below the first course of blocks of the wall, according to one embodiment.

As best shown in FIG. 7, which depicts a retaining wall under construction, the footing 36 in the illustrated embodiment includes a lower portion or stem 40 located in a trench 56 underneath the lowermost course **4*a* and an upper portion 42 that extends into the chambers 38 between adjacent block assemblies 10. The trench 56 can extend the entire length of the wall or only along certain sections of the wall that require reinforcement, such as because of poor soil conditions. Because the footing 36** increases the sliding resistance of the wall, it allows for a greater allowable height-to-width ratio for the wall than can normally be achieved. Thus, for a specified wall height, the base width of the wall can be reduced while maintaining the minimum required sliding resistance. Advantageously, this minimizes excavation and provides additional spaced in the embankment, such as for the placement of utility easements or other structures.

In particular embodiments, the footing 36 has a maximum width $W_3$ (FIG. 7) that is less than the overall depth $D_1$ (FIG. 2) of block assembly 10 and the width of the lowermost course (measured from the front of the wall to the back of the wall). The trench 56 has a base width $W_4$ at the trench bottom and a vertical depth $D_2$ that can vary depending on different factors, such as soil conditions and the overall height of the wall. Generally, increasing the depth $D_2$ of the trench increases the overall sliding resistance of the wall.

EXAMPLE

In one implementation, a retaining wall is constructed from a plurality of block assemblies 10 having a depth $D_1$ of about 32 inches, a width $W_1$ of about 18 inches, and a width $W_2$ of about 11.6 inches. Table 1 below shows the increase in sliding resistance for the wall that can be achieved by footings formed in trenches having a base width $W_4$ of 12 inches and depths $D_2$ of 12 inches, 18 inches, 24 inches, 30 inches, and 36 inches, for different soil strengths.

TABLE 1

| | Increased Horizontal Sliding Resistance for a 12 Inch Wide Trench | | | | |
|---|---|---|---|---|---|
| Phi Soil Strength (degs.) | 12 inch trench depth (lbsf/ft.) | 18 inch trench depth (lbsf/ft.) | 24 inch trench depth (lbsf/ft.) | 30 inch trench depth (lbsf/ft.) | 36 inch trench depth (lbsf/ft.) |
| 24 | 73 | 204 | 399 | 660 | 986 |
| 26 | 79 | 220 | 432 | 714 | 1,067 |
| 28 | 86 | 238 | 467 | 771 | 1,152 |
| 30 | 93 | 258 | 506 | 836 | 1,249 |
| 32 | 101 | 280 | 549 | 907 | 1,355 |
| 34 | 109 | 304 | 595 | 984 | 1,470 |
| 36 | 119 | 331 | 648 | 1,071 | 1,600 |
| 38 | 130 | 361 | 708 | 1,170 | 1,748 |
| 40 | 143 | 396 | 776 | 1,283 | 1,917 |
| 42 | 156 | 434 | 851 | 1,406 | 2,101 |

Figure 9:
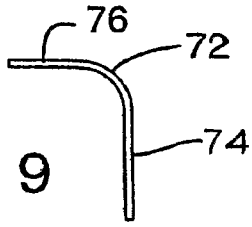
FIG. 9 is an enlarged side elevation of a reinforcing bar used in the concrete footing shown in FIGS. 7 and 8.

Referring to FIGS. 7 and 9, a method for constructing a reinforced retaining wall, according to one embodiment, will now be described. First, the trench 56 is excavated to a desired width $W_4$ and depth $D_2$ along the base of the embankment. As shown in FIG. 7, to level the existing grade, a front void or step 58 can be excavated in front of the trench 56 and a rear void or step 60 can be excavated in back of the trench. The soil in the voids can be compacted using conventional techniques. Concrete forms 62 and 64 can be placed in the front and rear voids 58, 60, respectively, and secured with stakes 66. Forms 62, 64 can be, for example, wooden 2×4's, conventional form boards, or various other materials. Forms 62, 64 serve as leveling pads for providing a level surface upon which the first course of blocks is to be constructed. Forms 62, 65 also function to elevate the block assemblies above the bottom of voids 58, 60 so that concrete can flow more easily under and around the trunk blocks when forming the footing 36.

The first course of the wall is then constructed by positioning a plurality of block assemblies 10 side-by-side above the trench 56 with the face blocks 12 supported on form 62, the anchor blocks 18 supported on form 64, and the trunk blocks 16 suspended above and spanning the width of the trench 56.

In an alternative embodiment, forms 62, 64 are not used and the face blocks 12 and the anchor blocks 18 are positioned on the bottom surfaces of the front and rear voids, or on leveling pads of compacted aggregate (or similar material) formed in the voids. In another embodiment, the front and rear voids 58, 60 are not excavated, and the face blocks 12 are positioned on the ground in front of the trench 56 and the anchor blocks 18 are positioned on the ground in back of the trench 56.

As discussed above, the trunk blocks are connected to respective face block and anchor blocks by tongue and groove dovetail joints that do not intersect the bottom surfaces of the blocks. Advantageously, this allows the trunk blocks to be suspended above the trench 56 and the voids 58, 60, as depicted in FIG. 7, without the need for supports placed underneath the front and rear end portions of the trunk blocks.

Figure 8:
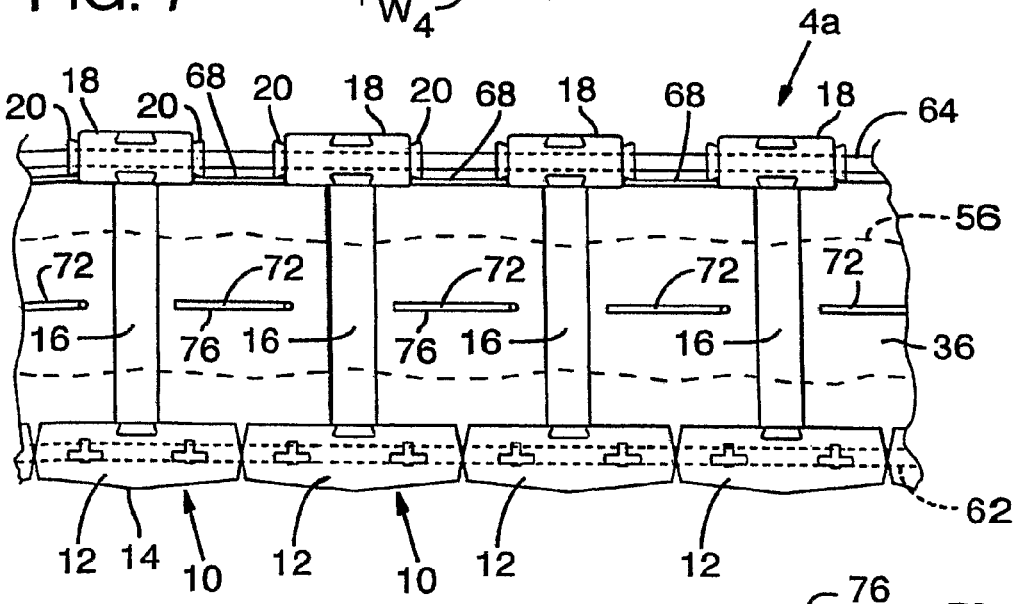
FIG. 8 is a top plan view of the partially constructed retaining wall with concrete footing shown in FIG. 7.

As best shown in FIG. 8, multiple forms 68 can be positioned to extend between the ends of adjacent anchor blocks 18. Forms 68 can be made of plywood, asphalt expansion joint board, or various other suitable materials. Forms 68 in the illustrated embodiment are positioned in front of tongues 20 (FIG. 8) and are secured to form 64 by respective spacers 70 (FIG. 7), although other techniques or methods can be used to secure forms 68 in place between the anchor blocks. For example, each form 68 can be retained in place by a frictional fit formed by the engagement of the form with a respective pair of anchor blocks. As can be appreciated, the face blocks 14, the anchor blocks 18, and forms 68 collectively define a concrete formwork for forming the upper portion 42 of the footing 36. In another implementation, the anchor blocks can be dimensioned so as to have a width $W_2$ that is equal to the width $W_1$ of the face blocks. Thus, in this implementation, the anchor blocks can be placed end-to-end in contacting relationship with each other and forms 68 would be optional.

To form the footing 36, concrete is introduced into the trench 56 and the chambers 38 via the upper openings of the chambers to fill the trench and at least partially fill the chambers with concrete. The chambers 38 desirably are filled with concrete to a level at or slightly below the upper surface of the block assemblies 10 of the first course. In particular embodiments, for example, the chambers are filled with concrete to about 2 inches below the upper surface of the block assemblies.

Before the concrete is allowed to cure, reinforcing bars 72 (e.g., steel rebar) can be inserted into the concrete between adjacent block assemblies (FIG. 8) to reinforce the footing. In an alternative embodiment, the reinforcing bars can be set in place in the formwork prior to pouring the concrete using conventional techniques. As best shown in FIG. 9, the illustrated reinforcing bar 72 has a lower portion 74 and an upper portion 76 forming a generally L-shaped member, although differently shaped reinforcing bars can be used in other embodiments (e.g., straight reinforcing bars). The reinforcing bars 72 desirably are positioned so that the lower portions 74 extend into the trench 56 (FIG. 7) and the upper portions 76 are situated in the chambers 38 and extend in the direction of the length of wall (FIG. 8).

After the concrete is allowed to cure, the empty portions of the voids 58, 60 outside of the formwork can be backfilled with a suitable fill material (e.g., aggregate or sand). If desired, preferably after is allowed to cure, one or more extension assemblies 40 (FIG. 1) can be added to the first course. Additional courses of block assemblies can be constructed on top of the first course in a vertical or set-back configuration, as previously described. Although less desirable, in other embodiments, extension assemblies and/or additional courses can be formed before the concrete is allowed to cure.

In alternative embodiments, multiple courses can be constructed over the trench 56 and concrete can be introduced into the trench, the chambers 38 of the first course and the chambers 38 of any additional courses overlying the first course so as to form a concrete footing that extends upwardly into multiple courses.

In some instances, a trench may have a tendency to collapse while forming a course of blocks over the trench, depending on the strength of the soil and/or the depth of the trench. When this is a concern, the portion of the footing in the trench can be formed prior to forming the lowermost course of blocks to prevent such collapse of the trench. FIGS. 10-13 illustrate one embodiment of such a method.

Figure 10:
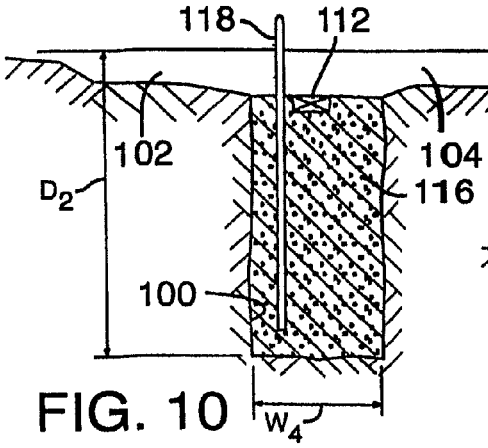
FIG. 10 is a vertical cross-sectional view of a trench and a lower footing portion formed in the trench, according to a second embodiment of a method for constructing a reinforced retaining wall.

Referring first to FIG. 10, in this embodiment, a trench 100 is excavated to a desired width $W_3$ and depth $D_2$ along the base of the embankment, and front and rear voids 102, 104, respectively, are formed in front of and in back of the trench, as previously described. If desired, the soil in the voids can be compacted using conventional techniques. Then, the trench 100 is filled with concrete to form a lower footing portion 116, which prevents the trench 100 from collapsing while the first course is being constructed over the trench.

Figure 13:
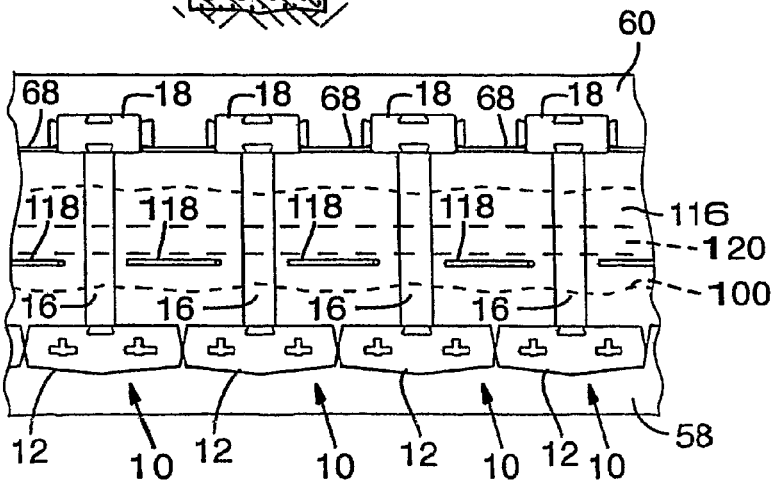
FIG. 13 is a top plan view of the course of blocks shown in FIG. 12.

Before the concrete in the trench has cured, L-shaped reinforcing bars 118 can be inserted into the concrete. The reinforcing bars 118 are allowed to extend above the existing grade, as depicted in FIG. 10, so that the upper portions of the reinforcing bars will be received in chambers 38 between adjacent block assemblies when the first course is formed. The reinforcing bars 118 are spaced along the length of the trench so that trunk blocks 16 can be positioned between the reinforcing bars when laying the first course of blocks (FIG. 13).

In certain embodiments, an elongated channel or groove 110 (FIG. 11) is formed along the upper surface of the lower footing portion 116. The channel 110 can be formed, for example, by pressing one or more forms 112 (e.g., wooden 2×4's) positioned end-to-end into the uncured concrete in the manner shown in FIG. 10. After the concrete cures, the forms 112 are removed to expose the channel 110 (FIG. 11).

Figure 11:
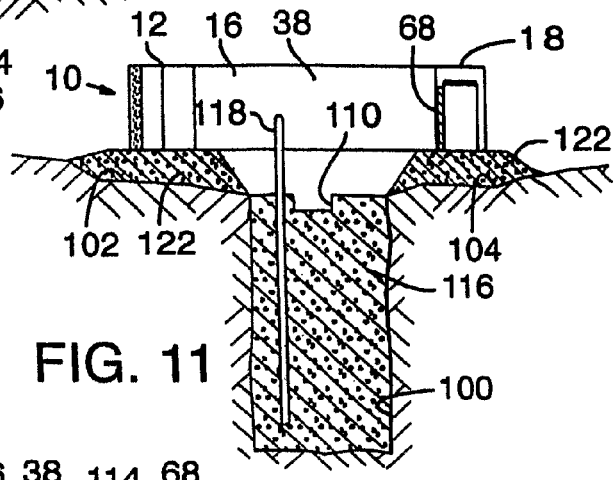
FIG. 11 is a vertical cross-sectional view showing a first course of blocks formed over the trench shown in FIG. 10.

Prior to forming the first course of block assemblies, as shown in FIG. 11, the voids 102, 104 desirably are at least partially filled with aggregate 122 (or other suitable fill material) and compacted to provide a level surface for supporting the first course. Alternatively, forms 62, 64 (FIG. 7) can be used in lieu of aggregate to provide a level surface for the first course. Other techniques or methods also can be used to provide a level surface for the first course. In any event, when laying the first course of block assemblies, the front blocks 12 are positioned on the aggregate 122 in void 102 and the anchor blocks 18 are positioned on the aggregate 122 in void 104 so that the trunk blocks 16 span the trench 100. Forms 68 can be positioned to extend between the ends of adjacent anchor blocks 18 to close the spaces between the anchor blocks (FIG. 13).

Figure 12:
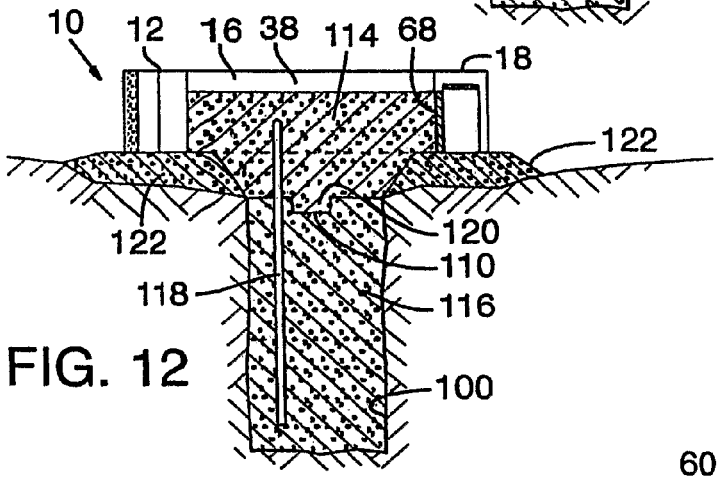
FIG. 12 is a vertical cross-sectional view similar to FIG. 11 showing an upper footer portion formed on top of the lower footing portion.

Thereafter, concrete is introduced into the chambers 38 between adjacent block assemblies via the upper openings of the chambers to form an upper footing portion 114. Concrete in the channel 110 forms a downwardly extending projection 120 of the upper footing portion 114 (FIG. 12). The projection 120 and the channel 110 forms an interlocking connection between the upper footing portion 114 and the lower footing portion 116 to help resist against sliding of the upper footing portion 114 relative to the lower footing portion in the forward direction. After the upper footing portion 114 is formed, one or more extension assemblies 40 can be added to the first course and/or one or more additional courses can be constructed on top of the first course.

Although the embodiments shown in FIGS. 1-13 relate to retaining walls constructed from block assemblies of interlocking block components, the methods described herein also can be used to construct retaining walls from various other types of block systems. In one embodiment, for example, a reinforced retaining wall is constructed from a plurality of unitary retaining wall blocks 200 (one of which is shown in FIG. 5). As used herein, a "unitary retaining wall block" refers a retaining wall block that does not form an interlocking connection with another retaining wall block in the same course.

The illustrated block 200 includes a front portion 202, a rear portion 204, and a neck portion 206 extending between the front portion 202 and the rear portion 204. The front portion 202 has a front surface 208 that is exposed in the front surface of a wall. The front surface 208 can have a broken face to resemble natural stone and can have any of various front-face configurations, such as the three-faceted configuration shown in FIG. 5. The block 200 can be formed with a vertical core or opening 210 extending through neck portion 206 so as to define two wall portions 212, 214 extending between the rear surface of the front portion 202 and the front surface of the rear portion 204.

The upper surface of the block 200 may be formed with alignment channels 216 and pockets, or recesses, 218 having a configuration that is similar to the alignment channels 26 and pockets 28 of the face block 12 (FIGS. 2 and 3). The alignment channels 216 in the illustrated configuration are generally centered on the "quarter points" of the upper surface of the front portion 202. The pockets 218 are dimensioned to receive plugs 52 of respective block-connecting elements 50. The block-connecting elements 50 can be inserted into the pockets 218 in a forward position for constructing a vertical wall or in a reversed position for constructing a setback wall, in the manner described above.

The method illustrated in FIGS. 7-9 can be used to construct a retaining wall from a plurality of blocks 200. For example, a trench is excavated to a desired depth $D_2$ and width $W_3$ that is less than the depth $D_3$ (FIG. 15) of block 200. To provide a level surface for forming the first course, front and rear voids can be excavated along the front and back of the trench and forms 62, 64 (FIG. 7) can be placed in the voids, as previously described. Then, the first course of blocks 200 is formed over the trench by positioning the front portions 202 of the blocks on form 62 and the rear portions 204 of the blocks on form 64. Other techniques also can be used to provide a level surface for the first course of blocks (e.g., forming aggregate leveling pads).

As can be appreciated, when the blocks are placed side-by-side to form the first course, a plurality of chambers or voids are defined between adjacent blocks. Voids in the first course are also defined by the cores 210 in the blocks. Since the width of the rear portions 204 is less than the width of the front portions 202, the rear portion of each block will be spaced from the rear portion of an adjacent block in a straight wall. The spaces between the rear portions can be closed by positioning forms 68 (FIG. 8) to extend between the rear portions of adjacent blocks.

After laying the first course of blocks, concrete is introduced into the trench and the voids of the first course (the cores 210 and the voids defined between adjacent blocks) to form a footing. Reinforcing bars 72 (FIG. 9) can be inserted into the uncured concrete to reinforce the footing. After the concrete has cured, one or more additional courses of blocks 200 can be constructed on top of the first course of blocks. If desired, tie-back sheets (not shown) can be installed between adjacent courses for additional anchoring strength.

In another embodiment, a retaining wall is constructed from a plurality of blocks 200 using the approach illustrated in FIGS. 10-13.

The present invention has been shown in the described embodiments for illustrative purposes only. The present invention may be subject to many modifications and changes without departing from the spirit or essential characteristics thereof. I therefore claim as my invention all such modifications as come within the spirit and scope of the following claims.

We claim:

1. A method for constructing a retaining wall, the method comprising:

forming a trench in the ground;

positioning a plurality of retaining wall blocks side-by-side to form a lowermost course of blocks spaced above the bottom of the trench and having voids between adjacent blocks; and forming a concrete footing in the trench and the voids between adjacent blocks to better resist against outward sliding forces exerted by retained earth at the lowermost course, wherein at least a portion of the footing is formed from a single layer of concrete occupying space in the voids and space below the blocks.

2. The method of claim 1, wherein the lowermost course has a width that is greater than the width of the footing.

3. The method of claim 1, wherein the front of the lowermost course of blocks is located in front of the trench and the back of the lowermost course of blocks is located in back of the trench.

4. The method of claim 1, wherein the lowermost course comprises a first course and the method further comprises forming a second course of retaining wall blocks over the first course.

5. The method of claim 4, wherein forming a second course of retaining wall blocks over the first course comprises connecting the blocks of the second course to the blocks of the first course by a mortarless connection.

6. The method of claim 5, comprising connecting the blocks of the second course to the blocks of the first course with a plurality of block-connecting elements extending into the upper surfaces of the blocks of the first course and the lower surfaces of the blocks of the second course.

7. The method of claim 1, wherein the lowermost course comprises a plurality of generally I-shaped block assemblies positioned side-by-side over the trench, each block assembly comprising a front block positioned in front of the trench, an anchor block positioned in back of the trench, and an elongated trunk block extending over the trench.

8. The method of claim 1, wherein forming a concrete footing in the trench and the voids comprises introducing concrete into the trench and the voids via the upper openings of the voids.

9. The method of claim 1, wherein the at least a portion of the footing comprises an upper portion of the footing and the footing further comprises a lower portion formed in the trench, and wherein at least the upper portion of the footing is formed after the lowermost course of blocks is formed by introducing concrete into the voids via the upper openings thereof.

10. The method of claim 1, wherein the at least a portion of the footing comprises an upper portion of the footing and the footing further comprises a lower portion and the method comprises forming the lower footing portion in the trench, forming the lowermost course of blocks after forming the lower footing portion, and forming the upper footing portion in the voids and in the space below the blocks after forming the lowermost course of blocks.

11. The method of claim 10, wherein forming the lower footing portion comprises forming an elongated channel in the upper surface of the lower footing portion, and forming the upper footing portion comprises forming a downwardly extending projection of the upper footing portion in the channel.

12. The retaining wall of claim 1, wherein the base comprises a lower portion and an upper portion, the lower portion comprising an elongated channel formed in the upper surface thereof, and the upper portion comprising a downwardly extending projection that is received within the channel.

13. The method of claim 1, further comprising positioning a first block support adjacent the front of the trench and a second block support adjacent the rear of the trench, and wherein the act of positioning the plurality of retaining wall blocks comprises positioning the plurality of retaining wall blocks on the first and second supports to form the lowermost course of blocks.

14. The method of claim 13, wherein the first and second block supports comprise concrete forms.

15. The method of claim 13, wherein the first and second block supports comprise first and second beds of aggregate.

16. The method of claim 13, wherein the first block support is disposed in a step adjacent the front of the trench and the second block support is disposed in a step adjacent the rear of the trench.

17. A method for constructing a retaining wall, the method comprising:

forming a trench in the ground at the base of the wall;

forming a lowermost course of retaining wall blocks over the trench, said course comprising a plurality of voids; and forming a concrete footing in the trench and the voids to interconnect the lowermost course with the ground to better resist against outward sliding forces exerted by retained earth at the lowermost course, wherein the footing has a width that is less than the width of the course.

18. The method of claim 17, comprising positioning the retaining wall blocks at a location spaced above the bottom of the trench.

19. The method of claim 17, wherein the portion of the footing formed in the voids is formed after the lowermost course of blocks is formed by introducing concrete into the voids via the upper openings thereof.

20. The method of claim 17, further comprising forming one or more additional courses of retaining wall blocks over the lowermost course after the footing cures.

21. The method of claim 17, wherein forming a concrete footing in the trench and the voids comprises introducing concrete into the trench and the voids and inserting reinforcing bars into the concrete before the concrete has cured.

22. The method of claim 17, wherein the voids comprise chambers defined between adjacent blocks in the lowermost course.

23. The method of claim 17, wherein the voids comprise openings formed in the blocks in the lowermost course.

24. The method of claim 17, wherein forming the lowermost course comprises positioning a plurality of block assemblies side-by-side over the trench, each block assembly comprising a front block positioned in front of the trench, an anchor block positioned in back of the trench, and an intermediate block extending between a respective front block and anchor block.

25. The method of claim 24, further comprising excavating a front void in the ground in front of the trench and excavating a rear void in the ground in back of the trench, and wherein the front blocks are positioned in or above the front voids and the anchor blocks are positioned in or above the rear voids.

26. The method of claim 25, further comprising positioning a first form in the front void and a second form in the rear void, and wherein the front blocks are supported on the first form and the anchor blocks are supported on the second form.

27. A method for constructing a retaining wall from a plurality of dry-stacked retaining wall blocks, the method comprising:

forming a trench in the ground at the base of an embankment to be retained by the wall;

positioning a plurality of retaining wall block assemblies side-by-side over the trench to form a lowermost course having a plurality of voids, wherein each block assembly comprises a plurality of interconnected blocks;

forming a concrete base in the trench and the voids of the lowermost course; and forming one or more additional courses on top of the lowermost course.

28. The method of claim 27, wherein at least an upper portion of the base is formed by introducing concrete into the voids via the upper openings thereof.

29. The method of claim 27, wherein the width of the lowermost course is greater than the width of the base.

30. A retaining wall comprising:

at least a first lower course of dry-stacked retaining wall blocks and a second upper course of dry-stacked retaining wall blocks, wherein each course comprises a plurality of voids; and a concrete footing having a lower portion located in a trench below the first course, wherein the lower portion comprises an upper surface having a groove; and an upper portion located in the voids of at least the first course, wherein the upper portion comprises a downwardly extending projection that forms an interlocking connection with the groove of the lower portion.

31. The retaining wall of claim 30, wherein the voids are defined between adjacent blocks in a course.

32. The retaining wall of claim 30, wherein the voids comprise vertically extending cores formed in the blocks.

33. The retaining wall of claim 30, wherein the blocks of the first course are interconnected to the blocks of the second course by a plurality of block-connecting elements, each block-connecting being received in a respective receptacle in a block of the first course and extending into a respective receptacle in a vertically adjacent block in the second course.

34. The retaining wall of claim 30, wherein the width of the footing is less than the width of the first course.

35. The retaining wall of claim 30, wherein the retaining wall blocks of the first course have a front portion extending forwardly of the trench, an anchor portion extending rearwardly of the trench, and an intermediate portion extending over the trench.

36. The retaining wall of claim 30, wherein each course comprises plural, side-by-side, generally I-shaped block assemblies, each block assembly comprising a front block, an anchor block oriented in a parallel relationship with respect to a respective front block, and a trunk block extending between a respective front block and anchor block, and wherein the front blocks of the first course extend forwardly of the trench and the anchor blocks of the first course extend rearwardly of the trench.

37. A retaining wall comprising:

at least a first lower course of retaining wall block assemblies and a second upper course of retaining wall block assemblies, wherein each block assembly comprises a front block positioned at the front of the wall, an anchor block disposed in a generally parallel relationship with respect to the front block, and an elongated trunk block extending between and connected to the front block and anchor block, and wherein each course comprises a plurality of chambers defined between adjacent block assemblies; and a concrete base located in a trench below the first course and extending upwardly into the chambers of the first course to help resist against forces exerted by retained earth at the base of the wall.

38. The retaining wall of claim 37, wherein the front blocks in the first course are located in front of the trench and the anchor blocks in the first course are located in back of the trench.

* * * * *